US007673484B1

(12) United States Patent
Crepinsek

(10) Patent No.: US 7,673,484 B1
(45) Date of Patent: Mar. 9, 2010

(54) KEY LOCK ASSEMBLY

(76) Inventor: Alois Crepinsek, P.O. Box 398, Chandler, AZ (US) 85244

( * ) Notice: Subject to any disclaimer, the term of this patent is extended or adjusted under 35 U.S.C. 154(b) by 0 days.

(21) Appl. No.: 12/018,673

(22) Filed: Jan. 23, 2008

Related U.S. Application Data

(60) Provisional application No. 60/886,398, filed on Jan. 24, 2007.

(51) Int. Cl.
*E05B 15/00* (2006.01)

(52) U.S. Cl. ..... 70/419; 70/358; 70/495

(58) Field of Classification Search ..... 70/358, 70/495, 496, 419–421
See application file for complete search history.

(56) References Cited

U.S. PATENT DOCUMENTS

| | | | | | |
|---|---|---|---|---|---|
| 3,142,168 | A * | 7/1964 | Wellekens | ..... | 70/416 |
| 3,590,615 | A * | 7/1971 | Schultz | ..... | 70/421 |
| 3,656,328 | A * | 4/1972 | Hughes | ..... | 70/276 |
| 3,882,703 | A * | 5/1975 | Hermann | ..... | 70/419 |
| 4,137,739 | A * | 2/1979 | Keller | ..... | 70/358 |
| 4,434,636 | A * | 3/1984 | Prunbauer | ..... | 70/358 |
| 4,490,998 | A * | 1/1985 | Wellekens | ..... | 70/419 |
| 4,638,651 | A * | 1/1987 | Surko, Jr. | ..... | 70/495 |
| 4,770,014 | A * | 9/1988 | Knauer | ..... | 70/358 |
| 5,475,998 | A * | 12/1995 | Raskevicius et al. | ..... | 70/495 |
| 5,485,735 | A * | 1/1996 | Laabs et al. | ..... | 70/358 |
| 5,758,526 | A * | 6/1998 | Gorokhovsky | ..... | 70/375 |
| 5,893,284 | A * | 4/1999 | Hrabal | ..... | 70/358 |
| 5,893,285 | A * | 4/1999 | Athanassiou | ..... | 70/493 |
| 6,058,750 | A * | 5/2000 | Li | ..... | 70/358 |
| 6,526,791 | B2 * | 3/2003 | Shvarts | ..... | 70/419 |
| 6,776,017 | B2 * | 8/2004 | Herdman | ..... | 70/338 |
| 6,910,356 | B2 * | 6/2005 | Price | ..... | 70/358 |
| 7,040,126 | B2 * | 5/2006 | Edwards, Jr. | ..... | 70/409 |
| 7,181,938 | B2 * | 2/2007 | Price | ..... | 70/358 |
| 7,487,653 | B2 * | 2/2009 | Widen | ..... | 70/409 |
| 7,584,635 | B2 * | 9/2009 | Gan et al. | ..... | 70/338 |
| 2005/0268678 | A1 * | 12/2005 | Price | ..... | 70/358 |

* cited by examiner

*Primary Examiner*—Suzanne D Barrett
(74) *Attorney, Agent, or Firm*—Parsons & Goltry; Michael W. Goltry; Robert A. Parsons

(57) ABSTRACT

A key lock assembly includes a core, formed with a keyway to accept a key, mounted to a fixture for rotation along a break point formed between the core and the fixture. A block assembly and rows of pin assemblies are mounted to the fixture and the core and are each formed with a break point. In a locked position of the key lock assembly the block assembly and the pin assemblies interact between the core and the fixture preventing the core from rotating relative to the fixture. In an unlocked position of the key lock assembly the key is inserted into the keyway interacting with the block assembly and the pin assemblies registering the break points of the block and pin assemblies with the break point formed between the core and the fixture allowing the core to rotate relative to the fixture.

6 Claims, 3 Drawing Sheets

KEY LOCK ASSEMBLY

CROSS-REFERENCE TO RELATED APPLICATION

This application claims the benefit of U.S. Provisional Application Ser. No. 60/886,398, filed Jan. 24, 2007.

FIELD OF THE INVENTION

The present invention relates to key locks.

BACKGROUND OF THE INVENTION

Key locks, particularly those employed with doors, such as doors utilized in residential and business applications, are well known and are available in many varieties. The type of door lock is often carefully selected based on the environment in which the door is to be used. For instance, the key locks used with doors in business establishments are often more rugged and expensive than those used in doors employed in residential applications.

A good key lock must be hard to unlock without the key. This is, of course, important for preventing unauthorized or unwanted intrusions, such as by burglars. Although the importance of good key locks cannot be overstated, over recent years relatively little attention has been directed toward improving the security of key locks. Because the same types of key locks are continually being installed in doors, both in new construction and in remodeling projects, attentive thieves have discovered the weaknesses of the existing key locks and have, it so appears, found ways to easily unlock these locks without the appropriate key. As a result, unwanted intrusions appear to be on the rise. Given the lack of meaningful innovations in the art of key locks in recent years, there is a need in the art for an improved key lock that is easy to build, efficient, highly secure, and exceptionally difficult to unlock without the appropriate key.

SUMMARY OF THE INVENTION

According to the invention, a key lock assembly includes a core assembly consisting of a core, formed with a keyway to accept a key, mounted to a fixture for rotation along a first break point formed between the core and the fixture. Pin assemblies are each mounted to the core assembly and are each formed with a second break point. A block assembly is mounted to the core assembly and is formed with a third break point. The pin assemblies and the block assembly are movable in reciprocal directions relative to the keyway between first positions, respectively, to place the key lock assembly in a locked position locking the core relative to the fixture and second positions, respectively, placing the key lock assembly in an unlocked position unlocking the core relative to the fixture. The locked position of the key lock assembly includes the block assembly concurrently engaging each of the pin assemblies and the pin assemblies and the block assembly interacting between the core and the fixture preventing the core from rotating relative to the fixture. The unlocked position of the key lock assembly includes the key inserted into the keyway interacting with and displacing the block assembly and the pin concurrently registering the second and third break points with the first break point permitting the core to rotate relative to the fixture. The pin assemblies and the block assembly are biased into the first positions thereof. The block assembly is further mounted to the core assembly for rocking movement relative to the keyway, and there are spaced-apart biases applied to the block assembly at spaced-apart positions along the block assembly each biasing the block assembly into the first position. The pin assemblies are arranged in rows opposing the block assembly. The rows of pin assemblies are offset relative to each other and the block assembly.

According to the invention, a key lock assembly includes a core assembly consisting of a core, formed with a keyway to accept a key, mounted to a fixture for rotation along a first break point formed between the core and the fixture. Pin assemblies are mounted to the core assembly, which each include an outermost pin having an outer end and an opposed inner end, and an opposed innermost pin having an outer end directed against the inner end of the outermost pin forming a second break point and an opposed inner end directed toward the keyway. A block assembly is mounted to the core assembly, which includes an outermost block having an outer end and an opposed inner end, and an opposed innermost block having an outer end directed against the inner end of the outermost block forming a third break point and an opposed inner end directed toward the keyway. The pin assemblies and the block assembly are movable in reciprocal directions relative to the keyway between first positions, respectively, to place the key lock assembly in a locked position locking the core relative to the fixture and second positions, respectively, placing the key lock assembly in an unlocked position unlocking the core relative to the fixture. The locked position of the key lock assembly consists of the inner end of the innermost block of the block assembly concurrently engaging each of the inner ends of the innermost pins of the pin assemblies and the pin assemblies and the block assembly interacting between the core and the fixture preventing the core from rotating relative to the fixture. The unlocked position of the key lock assembly consists of the key inserted into the keyway concurrently interacting with the inner end of the innermost block of the block assembly and the inner ends of the innermost pins of the pin assemblies displacing the block assembly and the pin assemblies concurrently registering the second break points of the pin assemblies and third break point of the block assembly with the first break point of the core assembly permitting the core to rotate relative to the fixture. The pin assemblies and the block assembly are biased into the first positions thereof. The block assembly is further mounted to the core assembly for rocking movement relative to the keyway, and there are spaced-apart biases applied to the block assembly at spaced-apart positions along the block assembly each biasing the block assembly into the first position. The pin assemblies are arranged in rows opposing the block assembly. The rows of pin assemblies are offset relative to each other and the block assembly.

Consistent with the foregoing summary of preferred embodiments, and the ensuing detailed description, which are to be taken together, the invention also contemplates associated embodiments.

BRIEF DESCRIPTION OF THE DRAWINGS

Referring to the drawings.

DETAILED DESCRIPTION OF PREFERRED EMBODIMENTS

Figure 1:
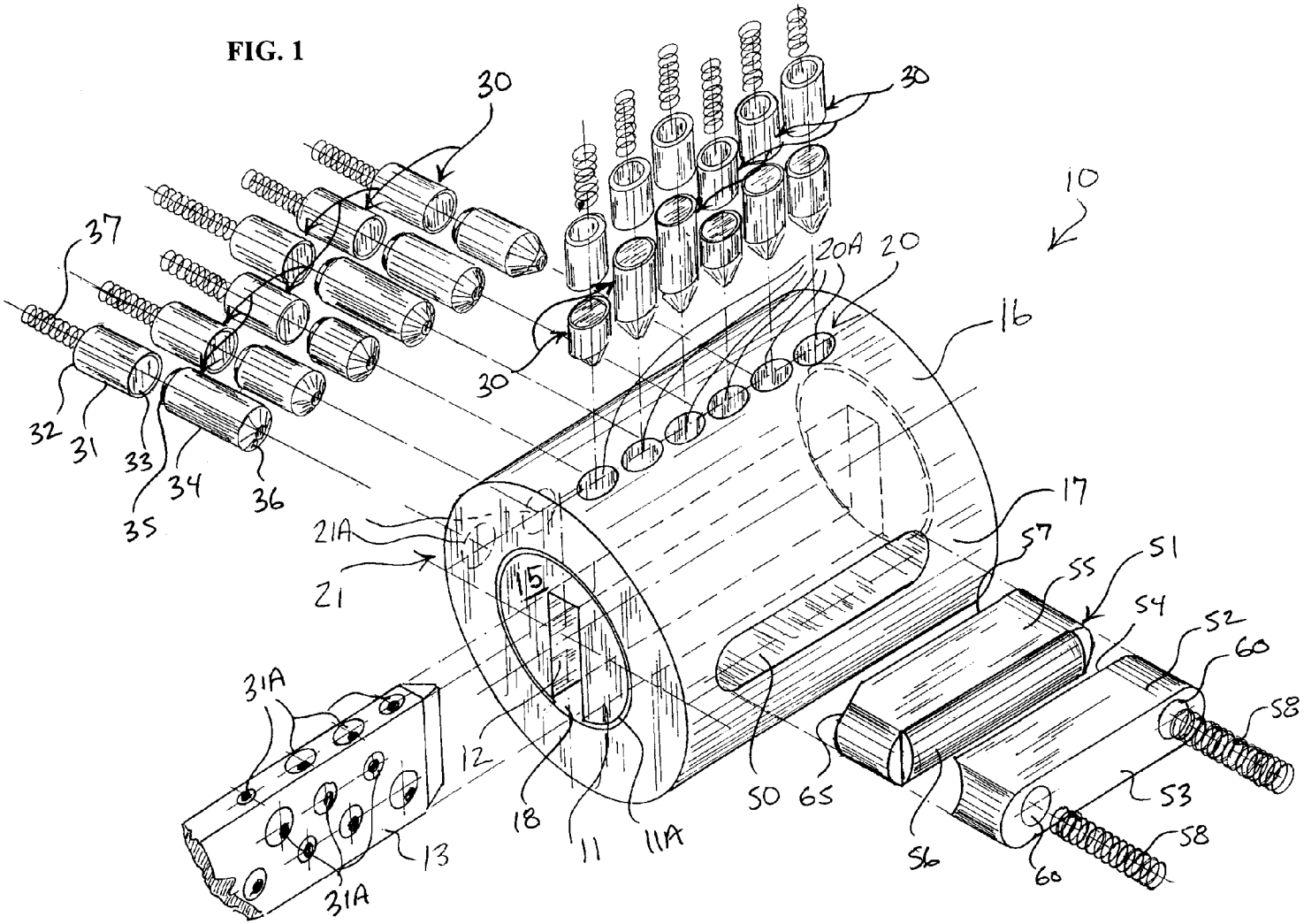
FIG. 1 is an exploded perspective view of a key lock assembly constructed and arranged in accordance with the principle of the invention.

Turning now to the drawings, in which like reference characters indicate corresponding elements throughout the several views, attention is first directed to FIG. 1 in which there is seen a key lock assembly 10 including a plug or core 11 fashioned with a keyhole or keyway 12 configured to accept a key 13. Core 11 is received in a bore 15 formed in a fixture, which in this instance is a substantial cylinder 16. Core 11 is retained in bore 15, and is encircled by cylinder 16. Bore 15 and core 11 have corresponding cylindrical shapes, and core 11 is mounted to cylinder 16 for rotation in bore 15, in which the combination of core 11 and cylinder 16 form a core assembly. Core 11 has a cylindrical outer or exterior surface 11A which faces a cylindrical interior or inner surface 18 of cylinder 16 that bounds and defines bore 15 defining a break point between core 11 and cylinder 16.

Cylinder 16 is formed with rows 20 and 21 of apertures 20A and 21B, respectively. In the present embodiment, rows 20 and 21 are offset approximately 90 degrees relative to one another. Row 20 is configured with six equally spaced-apart apertures 20A, although less or more may be used. Row 21 is also configured with six equally spaced-apart apertures 21A (only two are shown in phantom outline), although less or more may be used. Apertures 20A and 21A each accept a pin assembly 30. With the exception of having varying dimensions, principally varying lengths, pin assemblies 30 are each identical, and the ensuing discussion applies equally to each pin assembly 30.

Each pin assembly 30 includes an outermost pin 31 having opposed outer and inner ends 32 and 33 and length extending therebetween, an innermost pin 34 having opposed outer and inner ends 35 and 36 and a length extending therebetween, and a compression spring 37. Outermost pin 31 is directed outwardly toward outer surface 17 of cylinder 16, and innermost pin 34 is directed inwardly toward bore 15. Outer end 32 of outermost pin 31 is directed toward outer surface 17 of cylinder 16, inner end 33 of outermost pin 31 is directed against outer end 35 of innermost pin 34, and inner end 36 of innermost pin 34, which is tapered or otherwise somewhat rounded, is directed toward core 11 maintained in bore 15.

Figure 2:
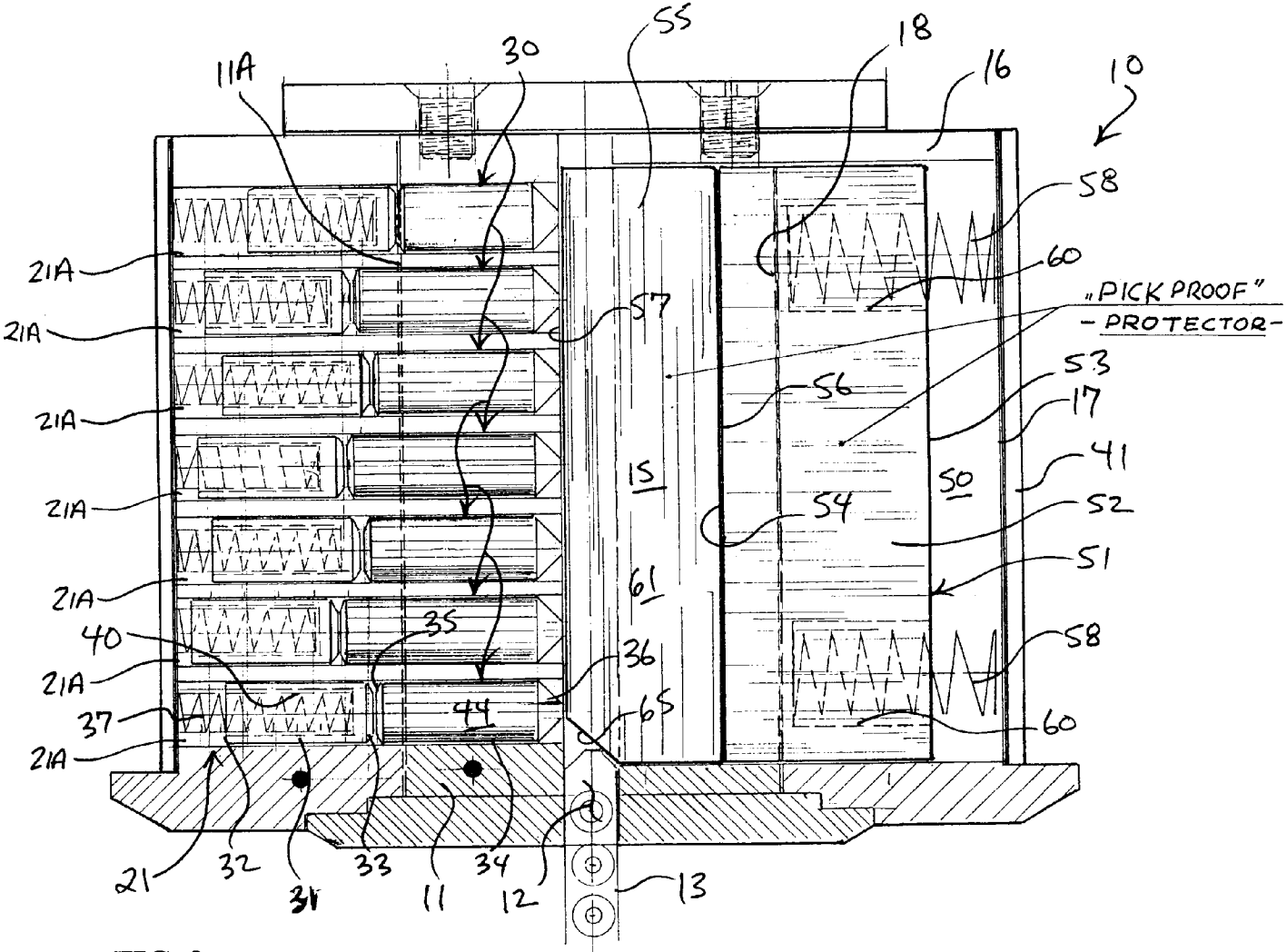
FIG. 2 is a horizontal sectional view of the key lock assembly of FIG. 1 shown as it would appear in a locked position.
Figure 3:
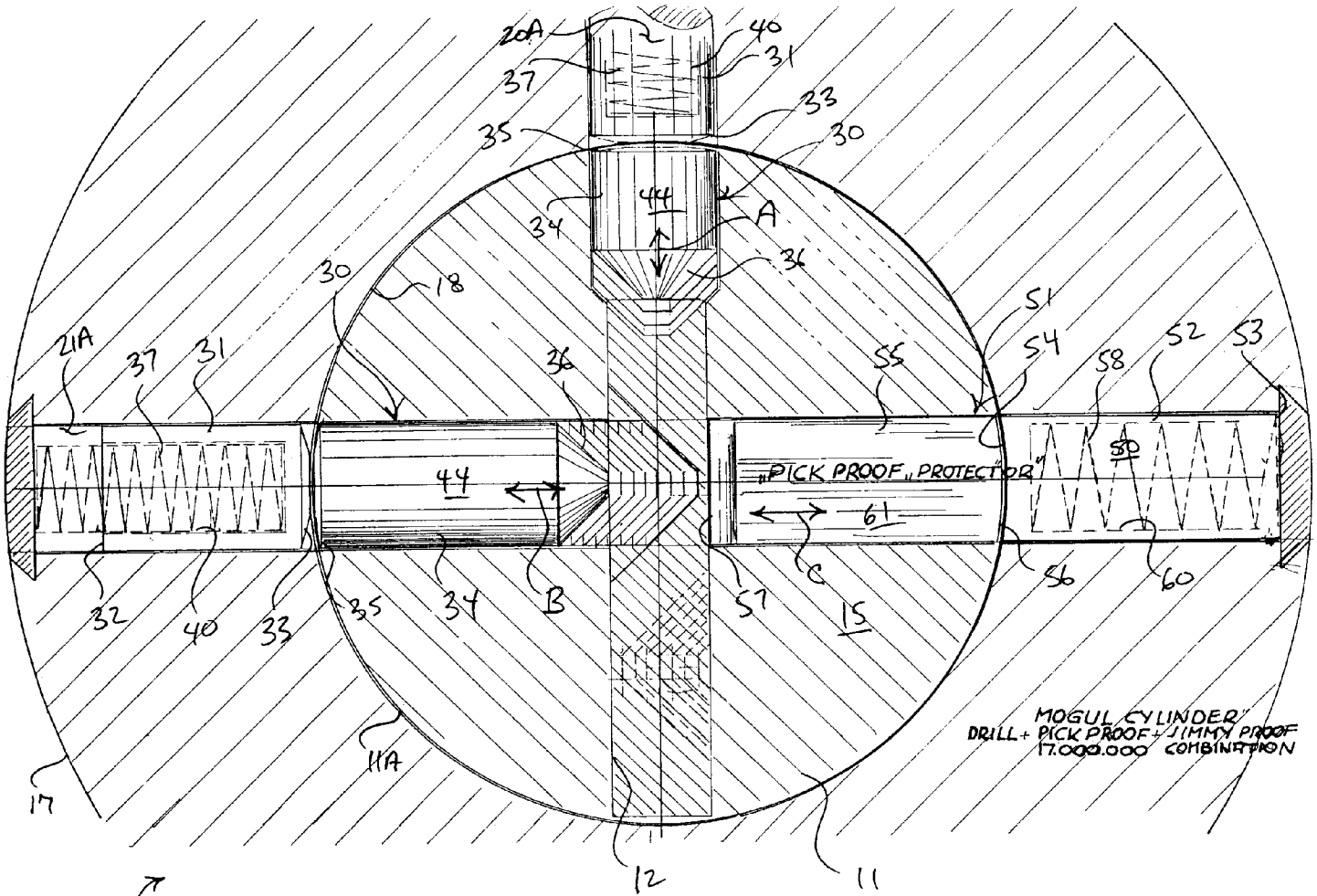
FIG. 3 is a vertical sectional view of the lock assembly of FIG. 1 shown as it would appear in an unlocked position.

A socket 40 is formed in outermost pin 31 through outer end 32. Compression spring 37 is held in place between socket 40 and a casing or shell 41 received over and encircling outer surface 17 of cylinder 16 as shown in FIG. 2. In particular, compression spring 37 has an end located in socket 40, and an opposed end directed against shell 41, whereby compression spring 37 extends therebetween and applies a bias against outermost pin 31 biasing inner end 33 of outermost pin 31 against outer end 35 of innermost pin 34, and, in turn, innermost pin 34 toward core 11 and bore 15 and, moreover, inner end 36 of innermost pin 34 into and through a corresponding aperture 44 formed in core 11 as illustrated in FIG. 3. The engagement point between inner end 33 of outermost pin 31 and outer end 35 of innermost pin 34 is considered a break point of the pin assembly 30 between outermost pin 31 and innermost pin 34. Inner end 33 of outermost pin 31 and outer end 35 of innermost pin 34 are somewhat rounded or tapered as illustrated. Aperture 44 communicates with keyway 12 allowing inner end 36 of innermost pin 34 to pass from aperture into keyway 12. The outermost and innermost pins of the pin assemblies 30 are fashioned of varying lengths.

With respect to row 20 of apertures 20A, it is to be understood that the outermost and innermost pins 31 and 34 of each pin assembly are free to reciprocate in and relative to the corresponding apertures 20A and 44 in which they are received as indicated by the double arrowed line A in FIG. 3. With respect to row 21 of apertures 21A, it is to be understood that the outermost and innermost pins 31 and 34 of each pin assembly are free to reciprocate in and relative to the corresponding apertures 21A and 44 in which they are received as indicated by the double arrowed line B in FIG. 3.

Referencing FIG. 1, an elongated slot 50 is formed in cylinder 16, which extends from outer surface 17 to bore 15, and which accepts a block assembly 51. Block assembly 51 includes an outermost block 52 having opposed outer and inner ends 53 and 54, an innermost block 55 having opposed outer and inner ends 56 and 57, and opposed compression springs 58. Outermost block 52 is directed outwardly toward outer surface 17 of cylinder 16, and innermost block 55 is directed inwardly toward bore 15. Outer end 53 of outermost block 52 is directed toward outer surface 17 of cylinder 16, inner end 54 of outermost block 52 is directed against outer end 56 of innermost block 55, and inner end 57 of innermost block 55 is directed toward core 11 maintained in bore 15. Inner end 54 of outermost block 52 is somewhat concave, and outer end 56 of innermost block 55 is somewhat convex, thereby forming a seated engagement therebetween. The curvatures defined by inner end 54 and outer end 56 are consistent with the curvatures formed by inner surface 18 of cylinder 16 and outer surface of core.

Opposed, spaced-apart sockets 60 are formed in outermost block 52 through outer end 53. Compression springs 58 are held in place between sockets 60, respectively, and casing or shell 41 received over and encircling outer surface 17 of cylinder 16 as shown in FIG. 2. In particular, each compression spring 58 has an end located in one of sockets 60, and an opposed end directed against shell 41, whereby compression springs 58 extend therebetween and apply a bias against outermost block 52 biasing inner end 54 of outermost block 52 against outer end 56 of innermost block 55, and, in turn, innermost block 55 toward core 11 and bore 15 and, moreover, inner end 57 of innermost block 55 into and through a corresponding elongated slot 61 formed in core 11 as illustrated in FIG. 3. Innermost block 55 is received in slot 61. Slot 61 communicates with keyway 12, allowing inner end 57 of innermost block 55 to pass from slot 61 into keyway 12. It is to be understood that the outermost and innermost blocks 52 and 55 of block assembly 51 are free to reciprocate in and relative to the corresponding slots 50 and 61 in which they are received, respectively, as indicated by the double arrowed line C in FIG. 3. As seen in FIG. 2, the portion of inner end 57 of innermost block 55 facing the opening formed by keyway 12 is chamfered as indicated by chamfered surface 65.

The engagement point between inner end 54 of outermost block 52 and outer end 56 of innermost block 55 is considered a break point of block assembly 51 between outermost block 52 and innermost block 55. Slot 50 and block assembly 51 carried thereby are offset approximately 90 degrees relative to row 20 of apertures 20A and the pin assemblies disposed therein, and are offset approximately 180 degrees relative to row 21 of apertures 21A and the pin assemblies carried thereby. Accordingly, block assembly 51 substantially opposes pin assemblies 30 carried by row 21 of apertures 21A.

Key lock assembly 10 is movable between a locked position as shown in FIG. 2 and an unlock position as represented in FIG. 3. In the locked position, core 11 is in a locked or starting position and is prevented from rotating in bore 15 relative to cylinder 16. In the unlocked position, core 11 is free to rotate in bore 15 relative to cylinder 16, and may therefore be rotated out of its locked or starting position into an unlocked position for actuating a latch bolt (not shown) operatively coupled to core 11. Key lock assembly 10 assumes the locked position when core 11 is placed into its locked or starting position and key 13 is removed from keyway 12, and assumes the unlocked position in response to key 13 located in keyway 12 in the starting or locked position of core 11. By operatively coupling core 11 with a bolt, such as a latch bolt, of a door lock, the bolt may be repeated moved between locked and unlocked positions as required in a preferred application of key lock assembly 10. In this regard, it is to be understood that key lock assembly 10 is suitable designed to be used with a door lock, whether utilized in connection with one door handle or knob, or two door handles or knobs.

In the locked position of key lock assembly 10 as shown in FIG. 2, core 11 is disposed in the locked or starting position whereby compression springs 37 of pin assemblies 30 bias the corresponding pairs of outermost and innermost pins 31 and 34 toward and into keyway 12, and compression springs 58 bias outermost and innermost blocks 52 and 55 toward keyway 12 bringing outer end 56 of innermost block 55 into concurrent engagement with each of the inner ends 36 of the innermost pins 34 of pin assemblies 30, whereby innermost pins 34 of pin assemblies 30 and outermost block 52 of block assembly 51 traverse the break point between core 11 and cylinder 16 thereby interacting between core 11 and cylinder 16 preventing core 11 from rotating in bore 15 relative to cylinder 16, in accordance with the principle of the invention. Keyway 12 is capable of accepting key 13. In the unlocked locked position of key lock assembly 10 as generally represented in FIG. 3, key 13 (not shown in FIG. 3) is inserted into keyway 12 in the locked or starting position of core 11 interacting with pin assemblies 30 and block assembly 51 overcoming the bias applied by compression springs 37 and 58 displacing block assembly 51 outwardly away from keyway 12 and also displacing pin assemblies 30 thereby concurrently registering the break points of pin assemblies 30 and block assembly 51 with the break point formed between core 11 and cylinder 16 permitting core 11 to rotate relative to cylinder 16. The tapered or substantially rounded configuration of inner ends 36 of innermost pins 34 of pin assemblies 30 and chamfered surface 65 of innermost block 55 disposed at the opening in to keyway 12 allows key 13 to be admitted into and through keyway 12 through the application of force to displace pin assemblies 30 and block assembly 51 in overcoming the bias applied by springs 37 and 58.

Key 13 is formed with detents 31A as illustrated in FIG. 1. When key 13 is inserted fully into keyway 12, inner ends 36 of innermost pins 34 of pin assemblies 30 each register with and fall into a corresponding one of the detents 13A formed in key 13 being thereby displaced causing the break points of pin assemblies 30 formed between the inner and outer ends 33 35 of the outermost and innermost 31 and 34 to register with the break point between core 11 and cylinder 16. The bias applied by springs 37 works against the outermost and innermost pins 31 and 34 driving inner ends 36 into the corresponding detents 13A. When key 13 is inserted fully into keyway 12, the bias applied by compression springs 58 is overcome displacing block assembly 51 outwardly away from keyway 12 causing the break point between inner and outer ends 54 and 56 of block assembly 51 to register with the break point between core 11 and cylinder 16. Accordingly, when key 13 is fully inserted into keyway 12, the break points of pin assemblies 30 and block assembly 51 together register with the break point between core 11 and cylinder 16 allowing core 11 to rotate out of its locked or starting position in bore 15 relative to cylinder 16, according to the invention. Through the bias applied by springs 37 of pin assemblies 30 and springs 58 of block assembly 51, removal of key 12 from keyway 13 in the locked or starting position of core 11 causes key lock assembly 10 to assume its locked position of FIG. 2.

Springs 58 are spaced apart, and thereby apply opposed biases across outermost block 52. In the event an unauthorized party attempts to pick lock assembly 10, such as with a screwdriver, pencil, toothpick, paper clip, or the like, the opposed biases applied to outermost block 52 causes outermost and innermost blocks 52 and 55 to rock back and forth uncontrollably thereby preventing the registration of the break point of block assembly 51 from registering with the break point between core 11 and cylinder 16 through the picking of lock. Furthermore, because the lengths of the outermost and innermost pins 31 and 34 of pin assemblies vary, the ability to pick key lock assembly 10 for concurrently setting the break points of pin assemblies 30 and block assembly 51 in registration with the break point between core 11 and cylinder 16 is simply not possible. Although two springs 58 are utilized in the present embodiment, more may be employed, if desired.

The present embodiment utilizes twelve pin assemblies and one block assembly in conjunction with key 13. In this arrangement, somewhere on the order of 17,000,000 possible combinations are possible with key lock assembly 10. Those having ordinary skill in the art will readily appreciate that the number of pin assemblies and block assemblies and corresponding detents formed in the key and also the lengths of the outermost and innermost pins of the pin assemblies can be varied as needed for providing virtually an unlimited number of potential combinations. Furthermore, although shell 41 is used to capture springs 37 and 58, plugs may be used, if desired.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A key lock assembly, comprising:

a core assembly, comprising a core, formed with a keyway to accept a key, mounted to a fixture for rotation along a first break point formed between the core and the fixture;

pin assemblies each mounted to the core assembly and each formed with a second break point;

a block assembly, mounted to the core assembly, comprising an outermost block, an innermost block, and a third break point formed between the outermost and innermost blocks;

the pin assemblies and the block assembly movable in reciprocal directions relative to the keyway between first positions, respectively, to place the key lock assembly in a locked position locking the core relative to the fixture and second positions, respectively, placing the key lock assembly in an unlocked position unlocking the core relative to the fixture;

the locked position of the key lock assembly comprising the innermost block of the block assembly concurrently engaging each of the pin assemblies and the pin assemblies and the block assembly interacting between the core and the fixture preventing the core from rotating relative to the fixture;

the unlocked position of the key lock assembly comprising the key inserted into the keyway interacting with and displacing the block assembly and the pin assemblies concurrently registering the second and third break points with the first break point permitting the core to rotate relative to the fixture;

a bias applied to each of the pin assemblies biasing each of the pin assemblies into the first position; and spaced-apart biases applied to the block assembly each biasing the block assembly into the first position.

2. The key lock assembly according to claim 1, wherein the pin assemblies are arranged in rows opposing the block assembly.

3. The key lock assembly according to claim 2, wherein the rows are offset relative to each other and the block assembly.

4. A key lock assembly, comprising:

a core assembly comprising a core, formed with a keyway to accept a key, mounted to a fixture for rotation along a first break point formed between the core and the fixture;

pin assemblies mounted to the core assembly each comprising an outermost pin having an outer end and an opposed inner end, and an opposed innermost pin having an outer end directed against the inner end of the outermost pin forming a second break point and an opposed inner end directed toward the keyway;

a block assembly mounted to the core assembly comprising an outermost block having an outer end and an opposed inner end, and an opposed innermost block having an outer end directed against the inner end of the outermost block forming a third break point and an opposed inner end directed toward the keyway;

the pin assemblies and the block assembly movable in reciprocal directions relative to the keyway between first positions, respectively, to place the key lock assembly in a locked position locking the core relative to the fixture and second positions, respectively, placing the key lock assembly in an unlocked position unlocking the core relative to the fixture;

the locked position of the key lock assembly comprising the inner end of the innermost block of the block assembly concurrently engaging each of the inner ends of the innermost pins of the pin assemblies and the pin assemblies and the block assembly interacting between the core and the fixture preventing the core from rotating relative to the fixture;

the unlocked position of the key lock assembly comprising the key inserted into the keyway concurrently interacting with the inner end of the innermost block of the block assembly and the inner ends of the innermost pins of the pin assemblies displacing the block assembly and the pin assemblies concurrently registering the second break points of the pin assemblies and third break point of the block assembly with the first break point of the core assembly permitting the core to rotate relative to the fixture;

a bias applied to each of the pin assemblies biasing each of the pin assemblies into the first position; and spaced-apart biases applied to the block assembly each biasing the block assembly into the first position.

5. The key lock assembly according to claim 4, wherein the pin assemblies are arranged in rows opposing the block assembly.

6. The key lock assembly according to claim 5, wherein the rows are offset relative to each other and the block assembly.

* * * * *